US007861372B2

(12) United States Patent
Tashima et al.

(10) Patent No.: US 7,861,372 B2
(45) Date of Patent: Jan. 4, 2011

(54) AUTOMOBILE DOOR CHECKER

(75) Inventors: Yuujiro Tashima, Wako (JP); Hidetoshi Ijuin, Wako (JP); Yasuhiko Yoshida, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 30 days.

(21) Appl. No.: 11/922,872

(22) PCT Filed: Jul. 13, 2006

(86) PCT No.: PCT/JP2006/313947

§ 371 (c)(1),
(2), (4) Date: Feb. 27, 2009

(87) PCT Pub. No.: WO2007/010812

PCT Pub. Date: Jan. 25, 2007

(65) Prior Publication Data

US 2009/0211056 A1 Aug. 27, 2009

(30) Foreign Application Priority Data

Jul. 15, 2005 (JP) ..... 2005-207489

(51) Int. Cl.
*E05C 17/22* (2006.01)

(52) U.S. Cl. ..... 16/86 C; 16/86 B

(58) Field of Classification Search ..... 16/86 B, 16/86 C, 86 R, 86 A, 277, 262, 265, DIG. 19; 292/265, 262, 277, DIG. 19; 296/146.12, 296/146.11
See application file for complete search history.

(56) References Cited

U.S. PATENT DOCUMENTS 2,268,976 A * 1/1942 Westrope ..... 16/86 C
5,474,344 A * 12/1995 Lee ..... 292/262
6,446,305 B1 * 9/2002 Kneeland ..... 16/82
6,813,811 B2 * 11/2004 Matsuki et al. ..... 16/86 B
7,143,473 B2 * 12/2006 Matsuki ..... 16/86 C

FOREIGN PATENT DOCUMENTS

| | | |
|---|---|---|
| DE | 196 14713 A1 | 10/1997 |
| DE | 29905318 U1 | 8/1999 |
| JP | 57-124568 | 8/1982 |
| JP | 60-155698 | 10/1985 |
| JP | 62-63370 | 4/1987 |

(Continued)

*Primary Examiner*—Chuck Y. Mah
(74) *Attorney, Agent, or Firm*—Carrier Blackman & Associates, P.C.; Joseph P. Carrier; William D. Blackman

(57) ABSTRACT

An automobile door checker includes a case secured to a door, a check plate that runs movably through the case and has its base end pivotably supported on a body, a detent member fitted into and retained by the case and working in cooperation with a detent face of the check plate and a resilient member that is formed from a resilient material and is provided in a compressed state in a housing chamber defined between an outer end face of the detent member and an inner end face of the case, wherein the resilient member substantially and tightly fills the housing chamber, thus preventing rainwater from infiltrating into the housing chamber. In this way, it is possible to prevent infiltration of rainwater into a housing chamber of a case housing a resilient member by a simple structure.

11 Claims, 6 Drawing Sheets

FOREIGN PATENT DOCUMENTS

| | | | |
|---|---|---|---|
| JP | 62-63371 | | 4/1987 |
| JP | 1-30514 | | 9/1989 |
| JP | 2-77338 | | 6/1990 |
| JP | 5-7201254 | | 8/1993 |
| JP | 7-145839 | | 6/1995 |
| JP | 3017041 | | 8/1995 |
| JP | 08210005 | A * | 8/1996 |
| JP | 09-256714 | | 9/1997 |
| JP | 11-241546 | | 9/1999 |
| JP | 2001-105863 | | 4/2001 |
| JP | 2001-349122 | | 12/2001 |
| JP | 2004-190431 | | 7/2004 |

* cited by examiner

AUTOMOBILE DOOR CHECKER

CROSS-REFERENCE TO RELATED APPLICATIONS

The present application is a U.S. National phase of, and claims priority based on PCT/JP2006/313947 filed 13 Jul. 2005, which, in turn, claims priority from Japanese patent application 2005-207489, filed 15 Jul. 2005. The entire disclosure of each of the referenced priority documents is incorporated herein by reference.

TECHNICAL FIELD

The present invention relates to an improvement of an automobile door checker that includes a case secured to one of an automobile body and a door pivotably supported on the automobile body, a check plate that runs movably through the case and is coupled to the other one of the body and the door, a detent member slidably fitted into and retained by the case so as to retain the door at a predetermined open position in cooperation with a detent face of the check plate, and a resilient member provided in a compressed state in a housing chamber defined between an outer end face of the detent member on a side opposite to the check plate and an inner end face of the case opposite this outer end face, and generates a detent force between the detent member and the detent face.

BACKGROUND ART

Such a door checker is already known, as disclosed in Patent Publication 1. Patent Publication 1: Japanese Patent Application Laid-open No. 9-256714

DISCLOSURE OF INVENTION

Problems to be Solved by the Invention

In such a conventional automobile door checker, since a space for allowing the resilient member to resiliently deform is provided between an outer face of the resilient member and the inner face of the case, rainwater might infiltrate into this space by moving along the check plate, etc., and if the rainwater freezes, the resilient deformation characteristics of the resilient member change, thus causing an uncomfortable sensation when opening and closing the door.

Accordingly, an arrangement is known in which the case or the check plate is covered by a waterproof cover to thus prevent rainwater from infiltrating into the case, but even in such an arrangement it is impossible to make the interior of the case completely watertight, the number of components increases, and the cost becomes high.

The present invention has been accomplished in the light of such circumstances, and it is an object thereof to provide an automobile door checker of the above type that prevents rainwater from infiltrating into a housing chamber of a case housing a resilient member by means of a simple structure.

SUMMARY OF THE INVENTION

In order to attain the above object, according to a first aspect of the present invention, there is provided an automobile door checker comprising a case secured to one of an automobile body and a door pivotably supported on the automobile body, a check plate that runs movably through the case and is coupled to the other one of the body and the door, a detent member slidably fitted into and retained by the case so as to retain the door at a predetermined open position in cooperation with a detent face of the check plate, and a resilient member that is made of a resilient material, is provided in a compressed state in a housing chamber defined between an outer end face of the detent member on a side opposite to the check plate and an inner end face of the case opposite the outer end face, and generates a detent force between the detent member and the detent face, characterized in that the resilient member substantially and tightly fills the housing chamber.

Further, according to a second aspect of the present invention, in addition to the first aspect, the resilient member is provided with a recess that is sealed by at least one of the outer end face and the inner end face.

Moreover, according to a third aspect of the present invention, in addition to the first or second aspect, the resilient member is formed from a hard portion having a relatively high modulus of elasticity and a soft portion having a relatively low modulus of elasticity.

Furthermore, according to a fourth aspect of the present invention, in addition to any one of the first to third aspects, the resilient member is made of a foamed resilient material having innumerable closed cells.

Furthermore, according to a fifth aspect of the present invention, in addition to the third aspect, the hard portion and the soft portion are molded separately.

Furthermore, according to a sixth aspect of the present invention, in addition to the fifth aspect, the thickness of the hard portion along the width direction of the detent is greater than the thickness of the soft portion in the same direction.

Furthermore, according to a seventh aspect of the present invention, in addition to the sixth aspect, the soft portion is disposed as a pair on opposite sides of the hard portion.

EFFECTS OF THE INVENTION

In accordance with the first aspect of the present invention, it is possible to prevent rainwater from infiltrating into the housing chamber by a very simple structure in which the resilient member substantially and tightly fills the housing chamber. It is therefore possible to prevent any change in the resilient deformation characteristics of the resilient member due to freezing of rainwater that has infiltrated into the housing chamber, thereby always maintaining a good opening and closing feel for the door.

In accordance with the second aspect of the present invention, the recess provided in the resilient member can be sealed by utilizing the outer end face of the detent member or the inner end face of the case, it is therefore possible to prevent rainwater from infiltrating into the recess, and resilient deformation of the resilient member can be ensured by the recess, thereby enhancing the reliability. Moreover, since the recess opens on the outer face of the resilient member, this can easily be formed by means of a mold when molding the resilient member.

In accordance with the third aspect of the present invention, since the hard portion having a relatively high elastic modulus exhibits a large resilient force to thus generate a large detent force between the detent face of the check plate and the detent member, the door can be reliably retained with a predetermined degree of opening, and since the soft portion easily absorbs resilient deformation of the hard portion, it can contribute to maintaining the original resilient function of the hard portion.

In accordance with the fourth aspect of the present invention, the resilient member made of a foamed resilient material can be given good resilient deformation characteristics due to the closed cells and, moreover, since the closed cells do not permit the infiltration of rainwater, penetration of rainwater into the resilient member can be prevented, and good resilient deformation characteristics can be maintained for the resilient member.

In accordance with the fifth aspect of the present invention, since the hard portion and the soft portion are molded separately, a desired shape and elastic modulus can be imparted easily and freely to each, and both performance and productivity can be satisfied.

In accordance with the sixth aspect of the present invention, the detent force can be fully ensured by the thick hard portion.

In accordance with the seventh aspect of the present invention, the hard portion can ensure that the detent force is sufficient, and the soft portion and the hard portion work in cooperation with each other as a pair, thus reliably preventing rainwater from infiltrating into the housing chamber.

The above-mentioned object, other objects, features, and advantages of the present invention will become apparent from an explanation of preferred embodiments described in detail below by reference to the attached drawings.

EXPLANATION OF REFERENCE NUMERALS AND SYMBOLS

Figure 1:
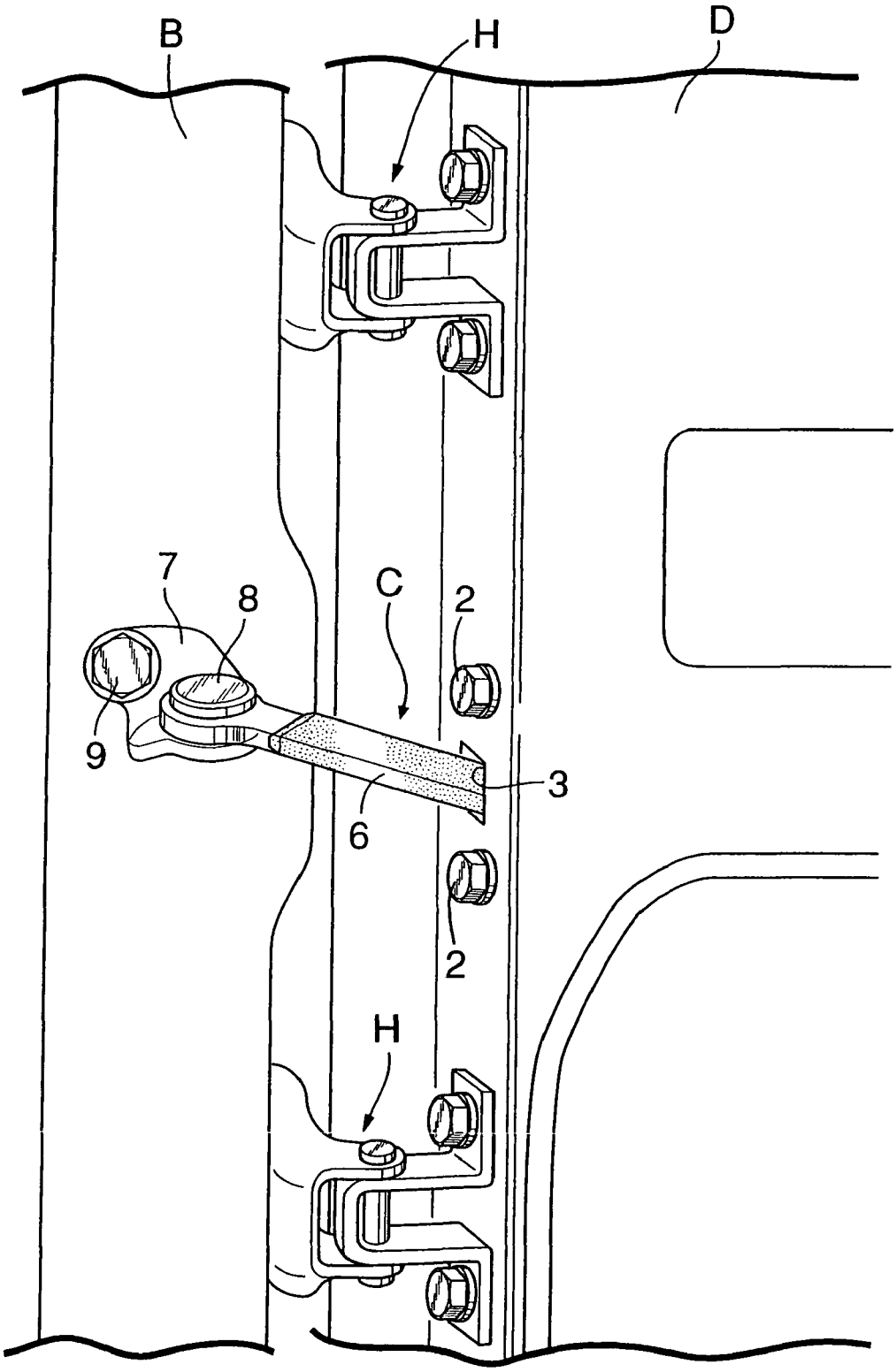
FIG. 1 is a perspective view of an essential part of an automobile on which the door checker related to a first embodiment of the present invention is mounted (first embodiment).
Figure 2:
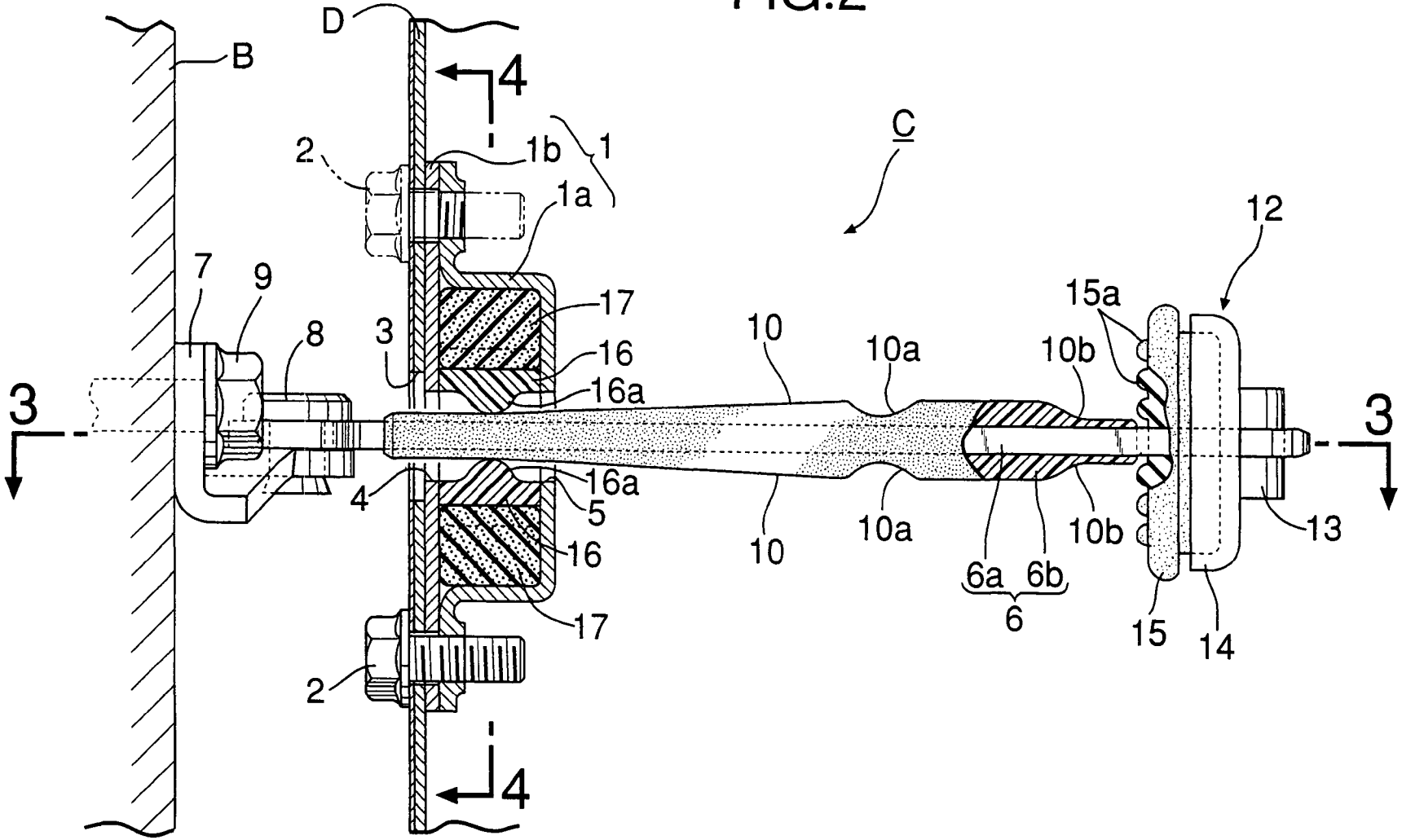
FIG. 2 is a side view in which an essential part of the door checker is vertically sectioned (first embodiment).
Figure 3:
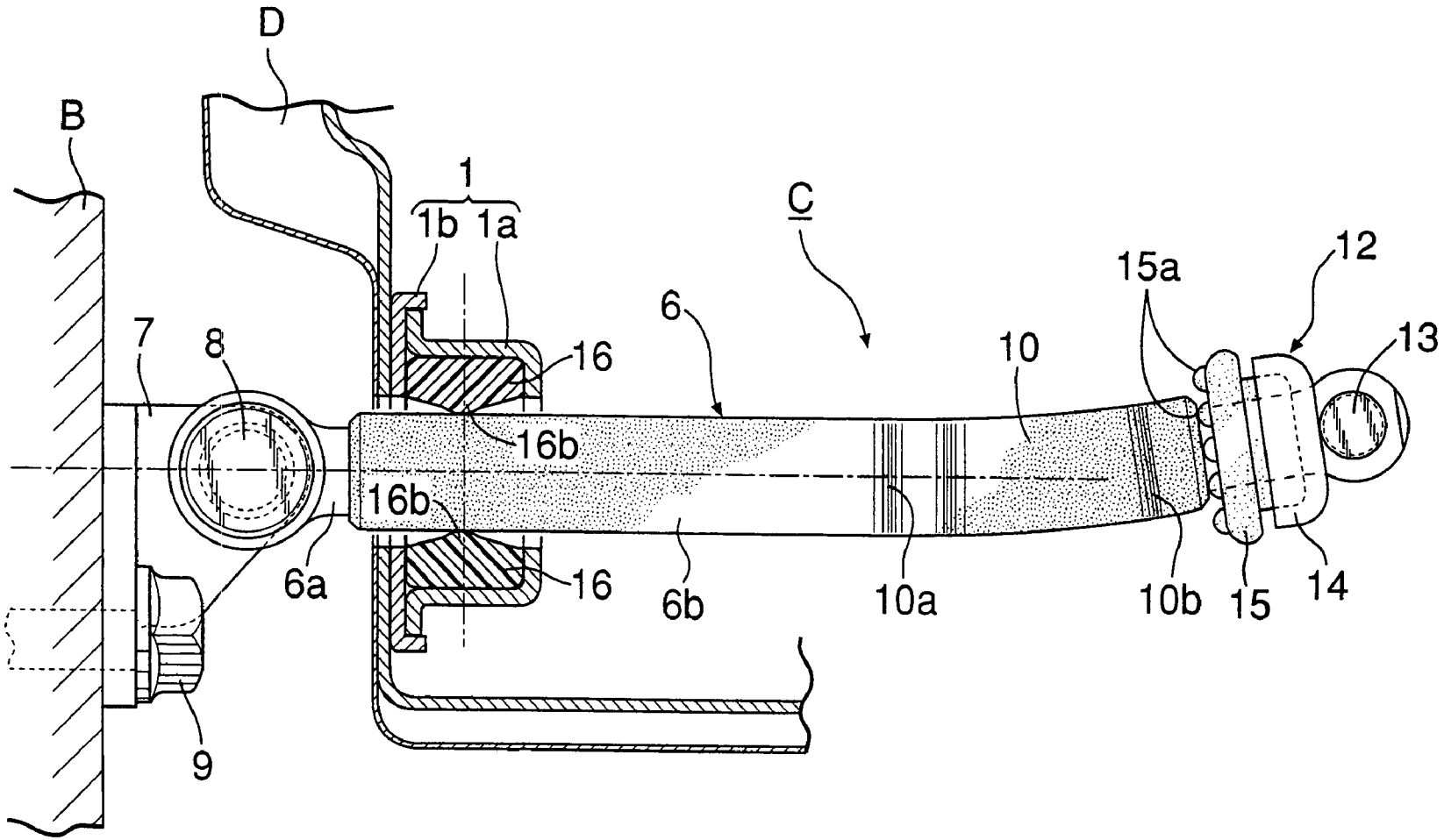
FIG. 3 is a sectional view along line 3-3 in FIG. 2 (first embodiment).
Figure 4:
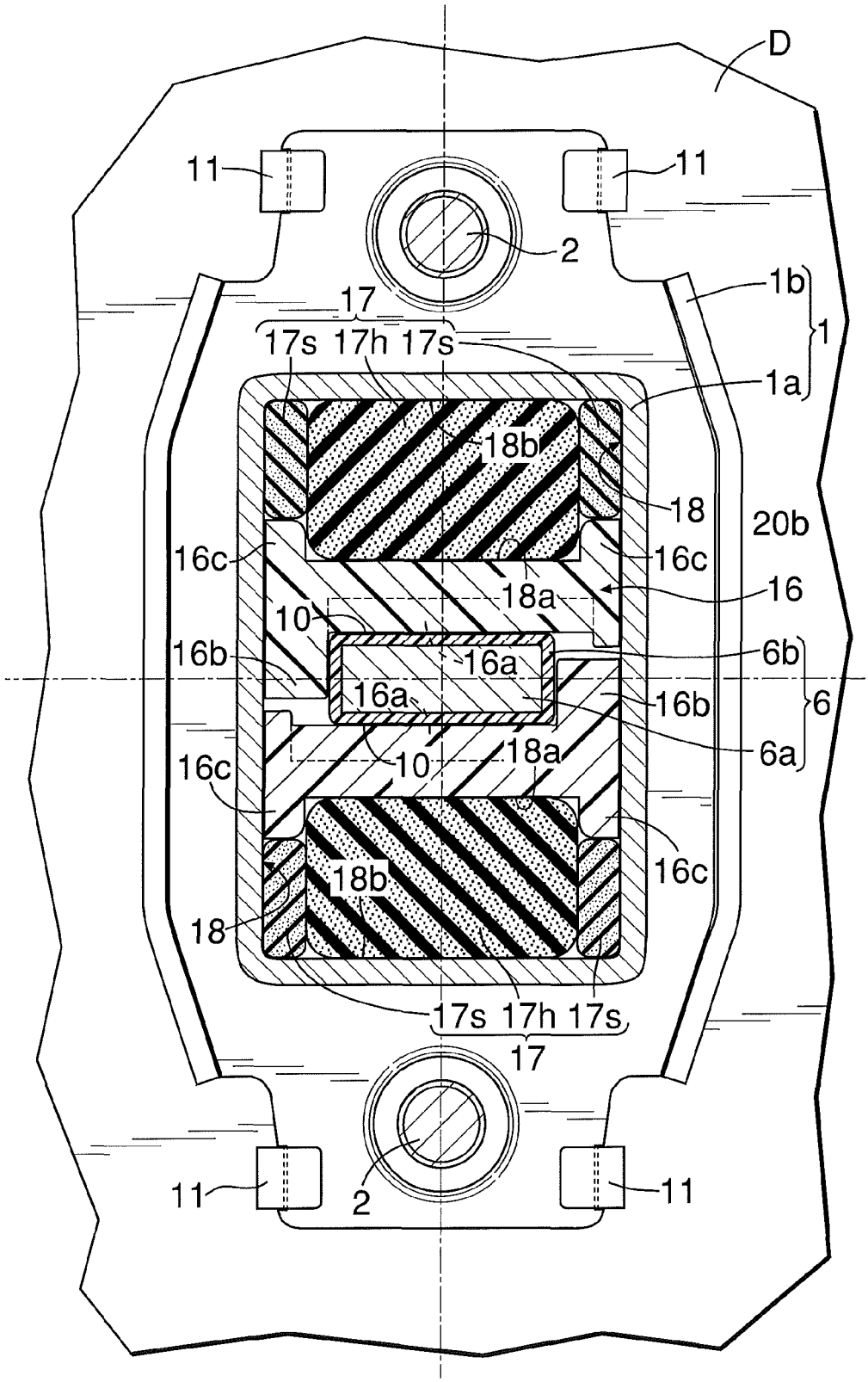
FIG. 4 is an enlarged sectional view along line 4-4 in FIG. 2 (first embodiment).
Figure 5:
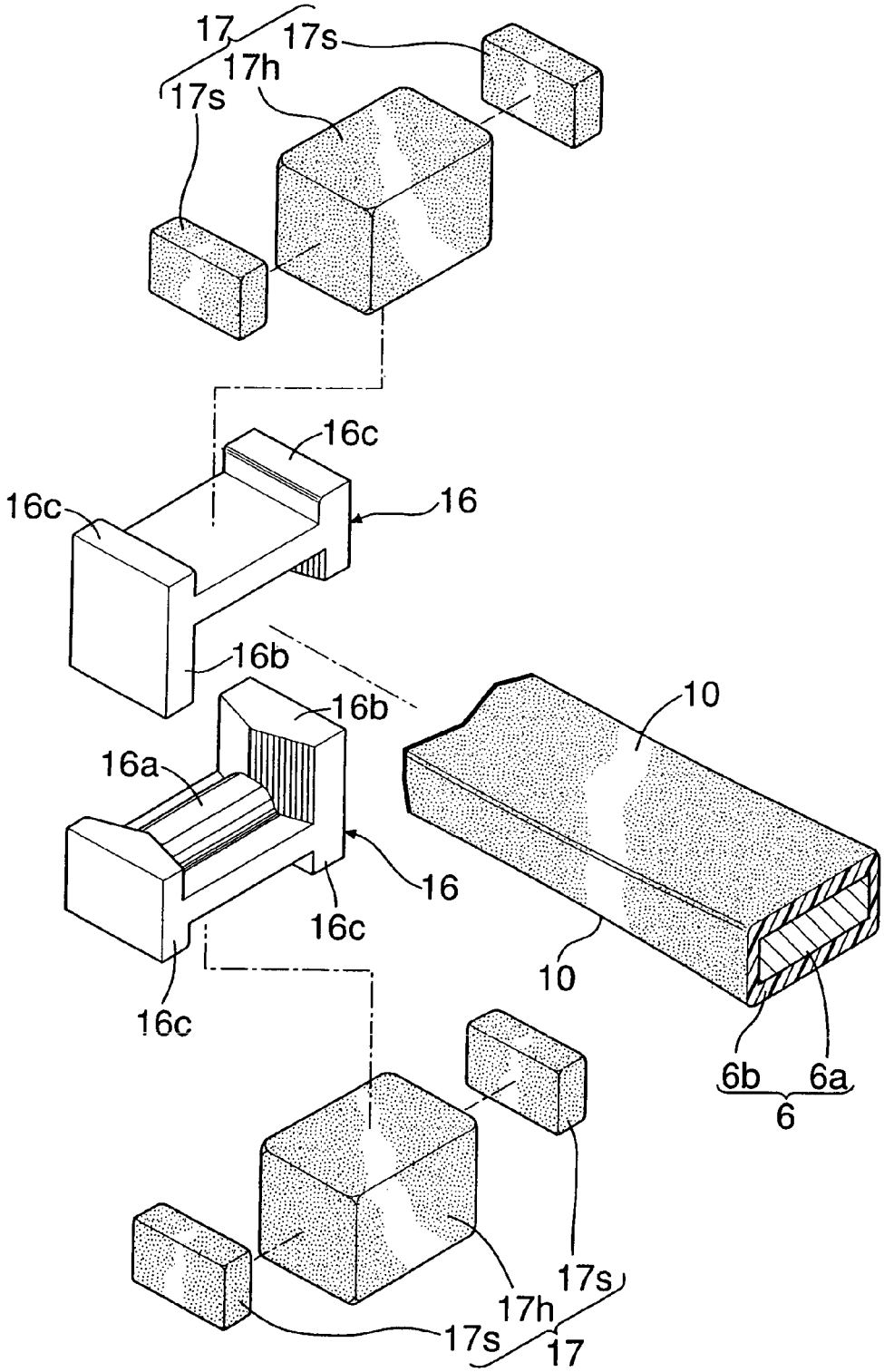
FIG. 5 is an exploded perspective view of an essential part of the door checker (first embodiment).

B Body
C Door checker
D Door
1 Case
6 Check plate
10 Detent face
16 Detent member
17 Resilient member
17*h* Hard portion
17*s* Soft portion
18 Housing chamber
18*a* Detent member outer end face
18*b* Case inner end face
20 Recess

DETAILED DESCRIPTION INCLUDING BEST MODE FOR CARRYING OUT THE INVENTION

Preferred embodiments of the present invention are explained below by reference to the attached drawings.

Embodiment 1

A first embodiment shown in FIG. 1 to FIG. 5 is now explained.

In FIG. 1, a door D is pivotably mounted on an automobile body B via a hinge H so as to open and close its entrance, and a door checker C of the present invention is mounted on the door D between the body B and the door D.

As shown in FIG. 1 to FIG. 4, the door checker C has a case 1 secured to an inner face of an end wall of the door D. This case 1 is formed from a box-shaped case main body 1*a* having one end open and a cover 1*b* joined to the case main body 1*a* via swage portions 11 and 11 (see FIG. 4) while covering the open end, and the case main body 1*a* and the cover 1*b* are secured to the end wall of the door D by means of a pair of upper and lower bolts 2 and 2 so that the cover 1*b* abuts against the inner face of the end wall. The cover 1*b* and the case main body 1*a* are provided with through holes 4 and 5 arranged coaxially with a through hole 3 opening in the end wall of the door D, a base end of a check plate 6 running through these three through holes 3, 4, and 5 is coupled to a bracket 7 via a pivot 8 so that they are mutually pivotable, and this bracket 7 is secured to the body B via a bolt 9 so that the pivot 8 is disposed parallel to the pivot axis of the hinge H. The check plate 6 is disposed substantially horizontally, and upper and lower faces thereof serve as detent faces 10 and 10.

The check plate 6 is formed from a steel plate main body 6*a* directly coupled to the bracket 7 and disposed substantially horizontally and a synthetic resin covering body 6*b* mold-bonded to a peripheral face of the plate main body 6*a* apart from at opposite ends. The covering body 6*b* is formed so that a gap between the upper and lower detent faces 10 and 10 of the check plate 6 gradually increases from the base end side (the bracket 7 side) toward the free end side of the plate 6, a half-open detent notch 10*a* is formed in a longitudinally middle section of the detent faces 10 and 10, a fully-open detent notch 10*b* is formed in the vicinity of the free end portion, and a fully-open stopper 12 adjacent to the fully-open detent notch 10*b* is attached to the plate main body 6*a*. This fully-open stopper 12 is formed from a steel stopper plate 14 secured to the plate main body 6*a* via a pin 13 and a stopper rubber 15 mounted on the stopper plate 14 and facing the fully-open detent notch 10*b*, and a large number of cushion projections 15*a* protrude from an end face of the stopper rubber 15 facing the fully-open detent notch 10*b*. The width of the check plate 6 is substantially constant apart from opposite ends thereof.

In FIG. 2 to FIG. 5, a pair of upper and lower synthetic resin detent members 16 and 16 are fitted into and retained by the case 1 so that they can slide along the plate thickness direction of the check plate 6, the detent members 16 and 16 retaining the door D at a predetermined open position in cooperation with the pair of detent faces 10 and 10 of the check plate 6. These detent members 16 and 16 include a semi-cylindrical engagement portion 16*a* that can engage with the half-open detent notch 10*a* and the fully-open detent notch 10*b*. Furthermore, the two detent members 16 and 16 include guide walls 16*b* and 16*b* slidably supporting opposite side faces in the fore-and-aft direction of the check plate 6 in cooperation with each other. A pair of extension walls 16*c* and 16*c* are projectingly provided on opposite end parts of the outer end face 18*a*, which is on the side opposite to the check plate 6, of each of the detent members 16 and 16, the extension walls 16*c* and 16*c* lengthening the sliding span of the detent member 16 relative to the two inner faces of the case 1.

Housing chambers 18 and 18 are defined in the interior of the case 1 between outer end faces 18*a* of the detent members 16 and 16 and upper and lower inner end faces 18*b* of the case 1 facing the outer end faces 18*a*, and a pair of upper and lower resilient members 17 and 17 substantially and tightly fill the housing chambers 18 and 18, the resilient members 17 and 17 resiliently urging the detent members 16 and 16 against the detent faces 10 and 10 of the check plate 6.

Each resilient member 17 is made of a foamed resilient material having innumerable closed cells, and is formed from a hard portion 17*h* having a relatively high elastic modulus and a soft portion 17*s* having a relatively low elastic modulus, the hard portion 17*h* being for filling between the outer end face 18*a* of each detent member 16 apart from the pair of extension walls 16*c* and 16*c* and the corresponding inner end face 18*b* of the case 1, and the soft portion 17*s* being for filling between the pair of extension walls 16*c* and 16*c* and the corresponding inner end face 18*b* of the case 1. In this way, a pair of soft portions 17*s* and 17*s* having a small thickness in the width direction of the detent member 16 are disposed on either side of the hard portion 17*h* having a large thickness in the same direction. The hard portion 17*h* and the soft portion 17*s* are molded separately, and the elastic modulus of each is adjusted by the porosity thereof. That is, the porosity is adjusted so that it is relatively small for the hard portion 17*h* and relatively large for the soft portion 17*s*.

The operation of this embodiment is now explained.

When the door D is opened from a closed state, since the engagement portions 16*a* and 16*a* of the detent members 16 and 16 slide in response thereto so as to ascend the detent faces 10 and 10 of the check plate 6, and the resilient members 17 and 17 are compressed accompanying this, due to an increase in the resilient force a pressure contact force against the detent faces 10 and 10 of the detent members 16 and 16 increases, and an opening torque for the door D increases appropriately.

When the door D is opened to a predetermined half-open position, since the engagement portions 16*a* and 16*a* of the detent members 16 and 16 drop into the half-open detent notches 10*a* and 10*a* of the check plate 6 due to the resilient force of the resilient members 17 and 17, the opening torque for the door D rapidly increases, thereby retaining the door D at the predetermined half-open position.

Furthermore, when the engagement portions 16*a* and 16*a* of the detent members 16 and 16 are pulled out from the half-open detent notches 10*a* and 10*a* by applying a further opening force to the door D, and the door D is opened to a predetermined fully-open position, in this case the engagement portions 16*a* and 16*a* drop into the fully-open detent notches 10*b* and 10*b* and at the same time the case 1 is resiliently received by the stopper rubber 15, thereby retaining the door D at the fully-open position.

Furthermore, in the course of the door D being closed from the fully-open position, in the same manner as above the door D can be retained at the predetermined half-open position due to engagement between the engagement portions 16*a* and 16*a* of the detent members 16 and 16 and the half-open detent notches 10*a* and 10*a* and, moreover, when further closing the door D, since the engagement portions 16*a* and 16*a* of the detent members 16 and 16 slide so as to descend the detent faces 10 and 10 of the check plate 6, a closing torque for the door D decreases appropriately, thus enabling the closing to be carried out with little effort.

In this process, the detent members 16 and 16 slide vertically within the case 1 in response to them ascending and descending on the detent faces 10 and 10 and engaging with and disengaging from the detent notches 10*a* and 10*b*; 10*a* and 10*b*, and the resilient members 17 and 17 accordingly repeatedly undergo resilient deformation, that is, compression and expansion.

Since the resilient member 17 substantially and tightly fills the housing chamber 18 within the case 1, it is possible to prevent rainwater from infiltrating into the housing chamber 18 and, therefore, it is possible to prevent any change in the resilient deformation characteristics of the resilient member 17 due to freezing of rainwater that has infiltrated into the housing chamber 18, thereby always maintaining a good opening and closing feel for the door. Moreover, the structure in which the resilient member 17 substantially and tightly fills the housing chamber 18 is very simple and does not result in high cost.

Furthermore, since the resilient member 17 is made of a foamed resilient material containing innumerable closed cells, due to the closed cells good resilient deformation characteristics can be exhibited and, moreover, since the closed cells do not permit the infiltration of rainwater, it is possible to prevent rainwater from penetrating into the resilient member 17, thereby maintaining good resilient deformation characteristics for the resilient member 17.

Furthermore, since the resilient member 17 is formed from the hard portion 17*h*, which has a relatively large elastic modulus, and the soft portion 17*s*, which has a relatively small elastic modulus, the hard portion 17*h*, which has a relatively large elastic modulus, exhibits a large resilient force so as to generate a large detent force between the detent member 16 and the detent face 10 of the check plate 6, thus reliably retaining the door D with a predetermined degree of opening and, furthermore, the soft portion 17*s* easily absorbs resilient deformation of the hard portion 17*h*, thereby contributing to maintaining the original resilient function of the hard portion 17*h*.

In particular, since the pair of soft portions 17*s* and 17*s* having a small thickness in the width direction of the detent member 16 are disposed on either side of the hard portion 17*h* having a large thickness in the same direction, the thick hard portion 17*h* can ensure that the above detent force is sufficient, and the pair of thin soft portions 17*s* and 17*s* in cooperation with the thick hard portion 17*h* can reliably prevent rainwater from infiltrating into the housing chamber 18. Moreover, since the hard portion 17*h* and the soft portion 17*s* are molded separately, a desired shape and elastic modulus can be imparted easily and freely to each, and both performance and productivity can be satisfied.

Embodiment 2

Figure 6:
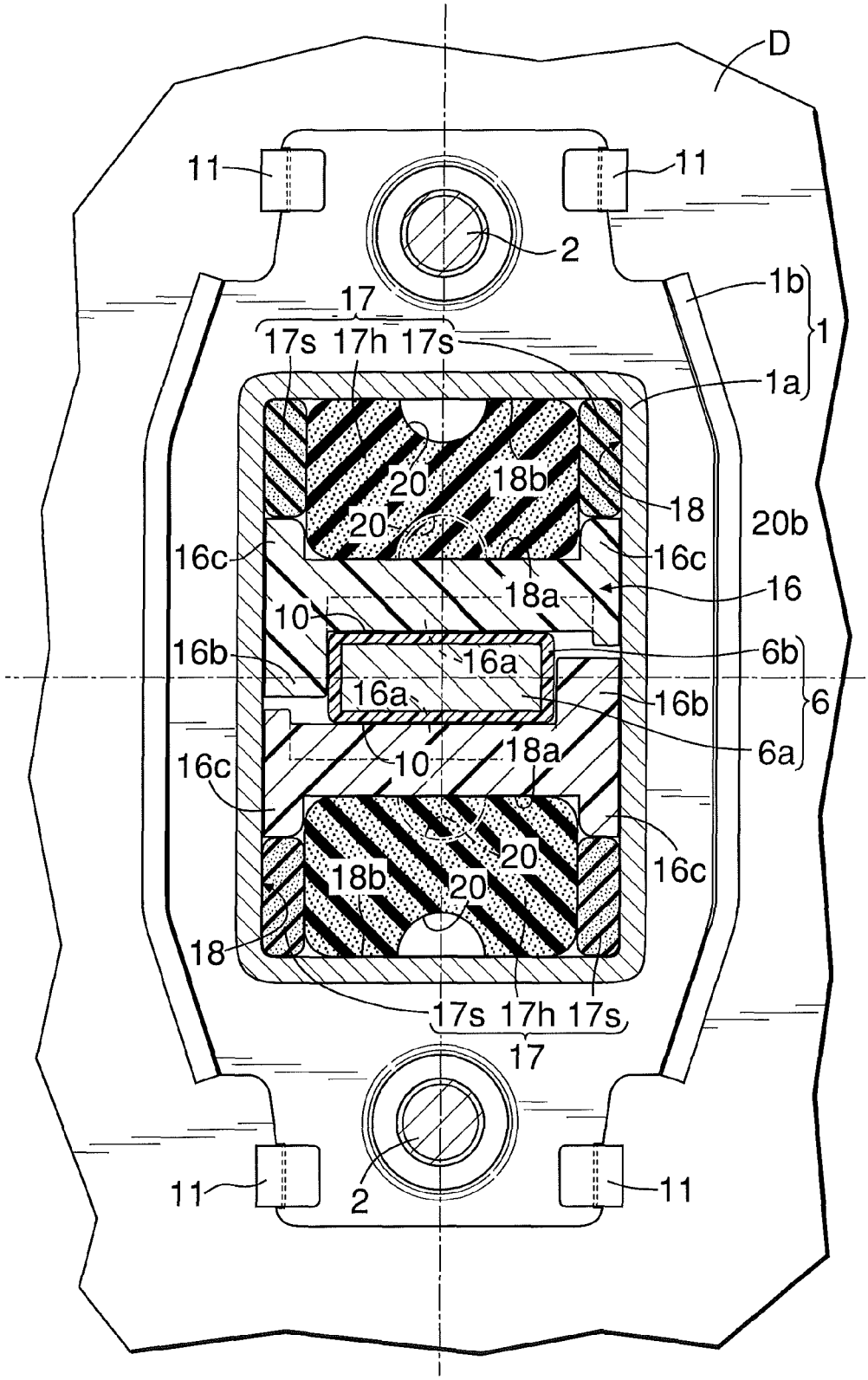
FIG. 6 is a view corresponding to FIG. 4 showing a different, second embodiment of the present invention (second embodiment).

A second embodiment of the present invention shown in FIG. 6 is now explained.

This embodiment has the same arrangement as that of the preceding embodiment except that the hard portion 17*h* of each resilient member 17 is provided with a recess 20 that is sealed by the inner end face 18*b* of the case 1 or the outer end face 18*a* of the detent member 16, and parts in FIG. 6 corresponding to the preceding embodiment are therefore denoted by the same reference numerals and symbols, thus avoiding duplication of the explanation.

In accordance with this embodiment, the resilient deformation characteristics of the hard portion 17*h* of the resilient member 17 can be freely adjusted by the volume of the recess 20 provided therein. Moreover, since the recess 20 is sealed by utilizing the inner end face 18*b* of the case 1 or the outer end face 18*a* of the detent member 16, it is possible to simply prevent rainwater from infiltrating into the recess 20, thereby stabilizing the resilient deformation characteristics of the hard portion 17*h*. Moreover, since the recess 20 opens on the outer face of the hard portion 17*h*, this can easily be formed by means of a mold when molding the hard portion 17*h*.

The present invention is not limited to the above-mentioned embodiments, and may be modified in a variety of ways as long as the modifications do not depart from the spirit and scope thereof. For example, after the hard portion 17*h* and the soft portion 17*s* forming the resilient member 17 are molded separately, they may be joined to each other and packed into the housing chamber, or they may be packed into the housing chamber without joining them. The hard portion 17*h* and the soft portion 17*s* may be integrally molded.

The invention claimed is:

1. An automobile door checker comprising:

a case secured to one of an automobile body and a door pivotally supported on the automobile body, a check plate that runs movably through the case and is coupled to the other one of the body and the door, a detent member slidably fitted into and retained by the case so as to retain the door at a predetermined open position in cooperation with a detent face of the check plate, and a resilient member that is provided in a compressed state in a housing chamber defined between an outer end face of the detent member on a side opposite to the check plate and an inner end face of the case opposite the outer end face, said resilient member operable to generate a detent force between the detent member and the detent face, wherein the resilient member substantially and tightly fills the housing chamber;

and wherein the resilient member comprises a hard portion having a relatively high modulus of elasticity, and a soft portion having a relatively low modulus of elasticity.

2. The automobile door checker according to claim 1, wherein the resilient member is provided with a recess that is sealed by at least one of the outer end face of the detent member and the inner end face of the case.

3. The automobile door checker according to claim 2, wherein the resilient member is made of a foamed resilient material having a multiplicity of closed cells.

4. The automobile door checker according to claim 2, wherein the hard portion and the soft portion are molded separately.

5. The automobile door checker according to claim 4, wherein the thickness of the hard portion along the width direction of the detent is greater than the thickness of the soft portion in the same direction.

6. The automobile door checker according to claim 5, wherein a pair of the soft portions are disposed on opposite sides of the hard portion.

7. The automobile door checker according to claim 1, wherein the hard portion and the soft portion are molded separately.

8. The automobile door checker according to claim 7, wherein the thickness of the hard portion along the width direction of the detent is greater than the thickness of the soft portion in the same direction.

9. The automobile door checker according to claim 8, wherein a pair of the soft portions are disposed on opposite sides of the hard portion.

10. The automobile door checker according to claim 1, wherein the resilient member is made of a foamed resilient material having a multiplicity of closed cells.

11. The automobile door checker according to claim 1, wherein a pair of extension walls are projectingly provided on opposite end parts of the outer end face, which is on the side opposite to the check plate of the detent member, the extension walls slidingly abutting against two inner faces of the case;

wherein the hard portion of the resilient member is clamped between the outer end face of the detent member other than the pair of extension walls and an inner end face of the case corresponding to the outer end face, and the soft portion of the resilient member is clamped and intimately contacted between tip end faces of the pair of extension walls and portions of the inner end face of the case corresponding to the tip end faces, respectively;

and wherein the hard portion of the resilient member is arranged at a position corresponding to the check plate while having a width larger than that of the check plate in a widthwise direction of the check plate that is perpendicular to a sliding direction of the detent member.

* * * * *